US009428991B1

(12) United States Patent
Abi Aad

(10) Patent No.: US 9,428,991 B1
(45) Date of Patent: Aug. 30, 2016

(54) MULTI-FRAC TOOL

(71) Applicant: Elie Robert Abi Aad, Jounieh (LB)

(72) Inventor: Elie Robert Abi Aad, Jounieh (LB)

( * ) Notice: Subject to any disclaimer, the term of this patent is extended or adjusted under 35 U.S.C. 154(b) by 0 days.

(21) Appl. No.: 14/715,478

(22) Filed: May 18, 2015

Related U.S. Application Data

(60) Provisional application No. 61/953,929, filed on Mar. 16, 2014.

(51) Int. Cl.

| | |
|---|---|
| ***E21B 34/12*** | (2006.01) |
| ***E21B 33/12*** | (2006.01) |
| ***E21B 34/16*** | (2006.01) |
| *E21B 34/00* | (2006.01) |

(52) U.S. Cl.
CPC ..... *E21B 34/12* (2013.01); *E21B 33/12* (2013.01); *E21B 34/16* (2013.01); *E21B 2034/007* (2013.01)

(58) Field of Classification Search
CPC ..... E21B 34/12; E21B 34/16; E21B 43/119; E21B 2034/007; E21B 33/12; E21B 43/26
See application file for complete search history.

(56) References Cited

U.S. PATENT DOCUMENTS

| | | | | |
|---|---|---|---|---|
| 5,012,871 | A * | 5/1991 | Pleasants | E21B 17/06 166/127 |
| 7,325,617 | B2 | 2/2008 | Murray | |
| 7,703,510 | B2 | 4/2010 | Xu | |
| 8,297,358 | B2 | 10/2012 | Korkmaz et al. | |
| 8,485,259 | B2 | 7/2013 | Sponchia et al. | |
| 2006/0124310 | A1 | 6/2006 | Lopez de Cardenas et al. | |
| 2007/0051521 | A1 | 3/2007 | Fike | |
| 2007/0261862 | A1 | 11/2007 | Murray | |
| 2009/0084553 | A1 | 4/2009 | Rytlewski et al. | |
| 2010/0108323 | A1 | 5/2010 | Wilkin | |
| 2010/0314133 | A1 | 12/2010 | O'Brien | |
| 2011/0186304 | A1 | 8/2011 | Tinker et al. | |
| 2012/0085548 | A1 | 4/2012 | Fleckenstein | |
| 2012/0111574 | A1* | 5/2012 | Desranleau | E21B 34/14 166/373 |
| 2015/0053408 | A1* | 2/2015 | Purkis | E21B 34/14 166/308.1 |
| 2015/0122489 | A1* | 5/2015 | Wood | E21B 43/14 166/250.01 |
| 2015/0167431 | A1* | 6/2015 | Purkis | E21B 23/04 166/373 |
| 2015/0308250 | A1* | 10/2015 | Anders | E21B 33/12 166/308.2 |
| 2016/0076335 | A1* | 3/2016 | Getzlaf | E21B 34/06 166/305.1 |
| 2016/0076338 | A1* | 3/2016 | Williamson, Jr. | E21B 23/006 166/373 |
| 2016/0097257 | A1* | 4/2016 | Jani | E21B 33/146 166/285 |

* cited by examiner

*Primary Examiner* — Shane Bomar
(74) *Attorney, Agent, or Firm* — Harrison Law Office, P.C.

(57) ABSTRACT

A downhole tool and concomitant methodology for selectively opening and closing multiple frac stages and multiple production zones in the absence of an intervention step. A sliding frac valve is disposed between a fixed open sleeve and a fixed mandrel. Under the influence of an open flow port or a closed flow port, the sliding frac valve is caused to slide in a predetermined direction to trigger emplacement of a locking rib cage within a corresponding recess, thereby locking the tool in an open or closed position. An option is provided for selectively filtering sand and other particulate impurities using a similarly slidable sliding screen valve.

6 Claims, 9 Drawing Sheets

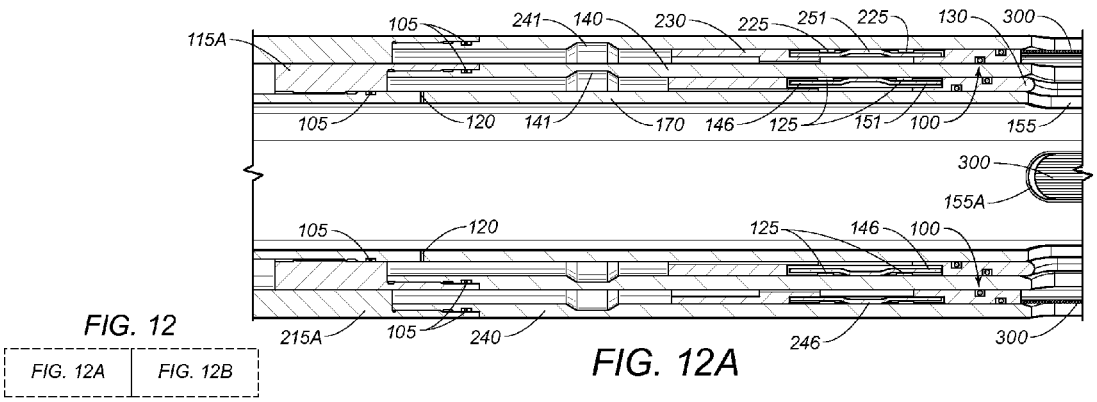
FIG. 12A
FIG. 12
| FIG. 12A | FIG. 12B |
|---|---|
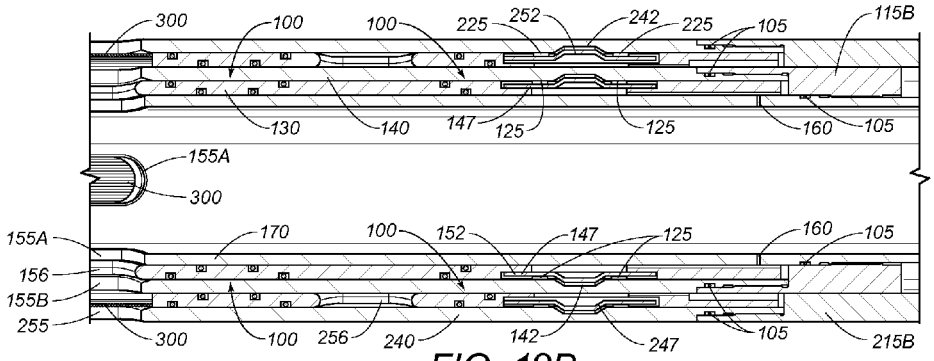
FIG. 12B

MULTI-FRAC TOOL

RELATED APPLICATIONS

This application claims priority based upon U.S. Provisional Application Ser. No. 61/953,929 filed Mar. 16, 2014.

FIELD OF THE INVENTION

The present invention relates to a downhole tool for selectively opening and closing multiple stages of hydrocarbon fluid flow during fracking operations and during production of hydrocarbons, and more particularly relates to an apparatus and system for receiving predetermined hydraulic pressure or other control signals from the surface to an opening port or a closing port to urge movement of a sliding frack valve to one of a plurality of positions that enable or lock down hydrocarbon fluid flow, respectively. When the downhole closing port receives pressure from the surface, the sliding frac valve is caused to slide in a prescribed direction wherein a slot contained thereon is misaligned with the slots contained on each of an open sleeve and a mandrel, both of which are immovable with their slots being permanently aligned. When the downhole opening port receives pressure from the surface, the sliding frack valve is caused to slide in an opposite direction wherein a slot contained thereon is aligned with the slots contained on each of an open sleeve and mandrel, thereby initiating or resuming hydrocarbon fluid in one of a plurality of frack stages or production zones.

BACKGROUND

There has been significant growth and developments in domestic applications of fracking during well completion operations. Special downwell equipment and downhole tools have been introduced to support and promote multi-zone production and during fracking operations, but a problem that has persisted is having the capability to efficiently open and close multiple frack stages and/or multiple production zones solely using permanently-placed downhole tools.

Furthermore, in order to promptly selectively shut down a particular frack stage or a particular production zone due to operational problems or change of circumstances, there is a paucity of tools and methodologies for effectively and reliably accomplish this crucial shut-down task without jeopardizing wellbore integrity. As will be readily appreciated by those skilled in that art, common approaches for handling this situation generally involve injecting cement into a wellbore which, unfortunately, shuts down production in all producing zones—not just the particular troublesome production zone. It will be understood that such approach adversely affects the plethora of pores permeating the producing zone and, indeed, requires substantial reworking if production from the wellbore were to be revived.

Those conversant in the art will understand that an intervention step would typically be prerequisite to address the challenge of selectively closing a particular frack stage or production zone in a multiple frack stage or multiple production zone scenario. There appears to have been a paucity of improvements in the art. The commonly used drop ball methodology for fracking seems to inherently preclude such selective opening and closing of stages or zones contemplated herein. Indeed, it should be evident that this drop ball approach precludes such opening and closing, and consequently requires that cementing be invoked to plug a wellbore which, of course, essentially undermines the well's prospects for further production. Sliding sleeve downhole tool embodiments have been applied to promote fracking using a series of plugs urged downhole under pressure. But, this sliding sleeve approach also significantly inhibits opening and closing as contemplated hereunder. Nevertheless, it appears that the heretofore most reliable method for shutting down and sealing a wellbore is to inject cement therein.

Accordingly, what is needed in the art is a downhole tool permanently emplaced within a wellbore using a packer affixed at each end thereof, having the inherent capability to selectively open and close multiple frack stages and multiple production zones without requiring not only a total shut-down of fracking operations or hydrocarbon production, but also just receiving a signal from the well surface that remotely triggers such specific opening and closing, in the absence of an additional intervening and costly step.

In view of these and other known deficiencies in the downhole art, it appears that selective opening and closing of multiple frack stages and multiple production zones has heretofore been and remains nonexistent. Accordingly, these limitations and disadvantages of the prior art are overcome with the present invention, wherein improved means and techniques are provided which are especially useful for using the multi-frac tool of the present invention with its in situ capability to effectively open and close frack stages and production zones.

SUMMARY

Embodiments of the present multi-frac tool pertain to selectively opening and closing a section of a plurality of frack sections constituting a frack stage. Embodiments afford a useful option of screening hydrocarbons during production to filter out particles of sand and other unavoidable downhole debris.

It will be seen that embodiments of the present invention enable downhole fracking operations to be segmented into up to 4 separate fracks contemplated to be as far apart 50 meters between each frack, whereupon a segment devolves to about 200 meters. This wellbore segmentation would be achieved using just one multi-frac tool of the present invention.

It will also be appreciated that, during production from a zone, if a problem should arise wherein production must cease, application of the instant downhole tool precludes usage of cement as is common in the art. Thus, by avoiding the prevalent cementing approach to abruptly cease production, the present invention inherently avoids typical wellbore damage and consequent undermining of other hydrocarbon producing zones.

Another important aspect of the present invention is that produced hydrocarbons can be filtered to separate sand and other impurities at the source in the wellbore, thereby preventing production pipe corrosion which is particularly advantageous since a variety of permanent production tools typically reside downhole during a well's lifetime.

It will be appreciated by those skilled in the art that the instant multi-frac tool, when disposed in an open position with all three slots being aligned, the sliding sleeve member would be positioned toward the bottom thereof, with a locking rib cage, in turn, positioned within the open sleeve and locked therein. As will become evident to those skilled in the art, considerable pressure will be prerequisite to compress the locking rib cage so that it vacates the recess, thereby enabling the sliding sleeve member to be urged into a corresponding closed position. It will be seen, that in this closed position, the sliding sleeve member would have slidably moved from one end of the tool to the other, wherein the locking rib cage is now disposed within another recess, the recess associated with the open sleeve member. It will become apparent that the sliding sleeve member slot is no longer aligned with the other two mandrel slots. Indeed, the sealing surface manifest in the sliding sleeve member will be blocking the passage of any flow either into or out of this sealing surface.

According to the present invention, to preclude flow, fluid pressure would be applied to at least one closing port preferably using a cup tool. Of course, it should be evident that a plurality of closing ports may be incorporated into embodiments hereof. Included on the mandrel is at least one channel that functions as a communication port. It will be appreciated that a plurality of such channels should preferably be arranged in a concentric and coplanar configuration to facilitate efficient linear inward flow It is accordingly an object of the present invention to provide a downhole tool that reduces operating costs by precluding the necessity for conventional cementing.

It is another object of the present invention to provide a downhole tool that affords simple deployment.

It is yet another object of the present invention to provide a downhole frack tool that enables up to four frack zones to be selectively opened and closed without jeopardizing wellbore integrity and hydrocarbon production potential, with only a single trip downhole.

It is also an object and advantage of the present invention that embodiments may be used to selectively filter sand and other impurities out of hydrocarbon production at the downhole source, thereby avoiding or at least minimizing the occurrence of corrosion.

These and other objects of the present invention will become apparent from the following specifications and accompanying drawings.

BRIEF DESCRIPTION OF THE DRAWINGS

FIGS. 12A and 12B depict enlarged cross-sectional views of the "open flow position with screen on" condition depicted in FIG. 9.

DETAILED DESCRIPTION

Reference is made herein to the figures in the accompanying drawings in which like numerals refer to like components. Now referring collectively to FIGS. 1-5 and 7-16, there are depicted embodiments of the present invention corresponding to downhole multi-frac tool that enables practitioners in the art to select one of a maximum of four frack zones to close during fracking operations or production of hydrocarbons for accommodating problems that may occur, without adversely affecting the integrity of the wellbore and future production of hydrocarbons. Accordingly, an embodiment of the present invention would be emplaced downhole at a predetermined depth in a wellbore after permanent production packers have been emplaced therein, and zonal shutdown would be expeditiously effectuated without interrupting other frack zones or production of hydrocarbons.

Figure 1:
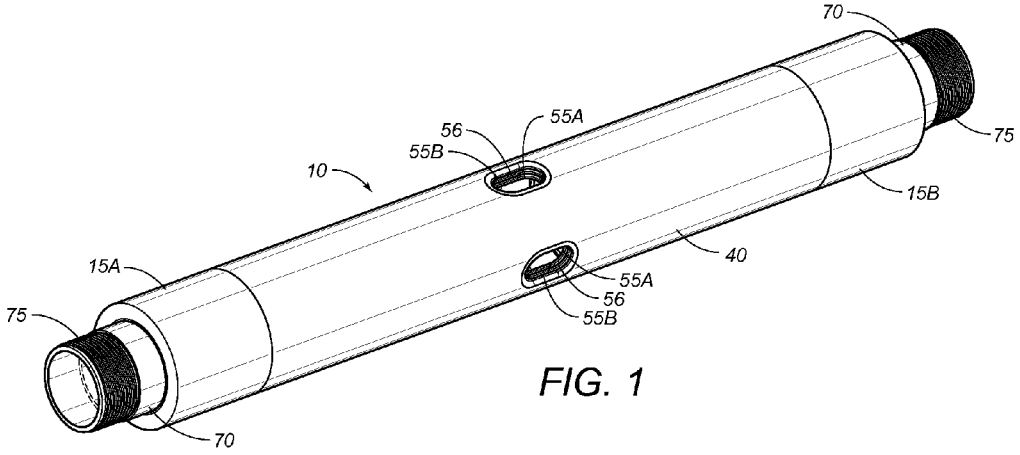
FIG. 1 depicts a frontal perspective view of an embodiment of the present invention.

Referring now to FIG. 1, there is seen a frontal perspective view of a multi-frac tool 10 embodiment taught by the present invention. Open sleeve 40 is affixed to mandrel 70 with customer-specified threads 75 depicted at each end of mandrel 70. At each end of embodiment 10 is end cap 15 A-B, Now referring to FIGS. 2A-B, there is depicted an enlarged view of the embodiment depicted in FIG. 1, disposed first in an open condition and then disposed in a closed condition. Sliding frack valve 35 is disposed medially of open sleeve 40 and mandrel 70.

As will become apparent to those skilled in the art, once the instant multi-frac tool is emplaced downhole and permanently situated connected to a packer pair (not shown). Mandrel 70 and open sleeve 40 remain fixed; only the sliding frack valve 35 moves along the mandrel as will be hereinafter described. Flow closing port 20 is shown at one end and flow opening port is shown at the opposite end thereof. It will be appreciated that each of these fluid flow ports should preferably comprise a plurality of channels that are preferably disposed in a concentric and coplanar configuration. Thus, to shut down fluid flow, hydraulic pressure would be applied to the flow closing port 20 whereupon there would be no communication between the reservoir and production in this zone being closed. According to the present invention, this shutdown is achieved when sliding frac valve 35 slides from left to right until the rib cage reaches the recess on the right side thereof and seats therein.

Sliding frac valve 35 has thus been urged into a closed position wherein its slot 56 is misaligned with each of the inherently aligned mandrel slot 55A and open sleeve slot 55B. It will be seen that frack valve sealing surface 36 would be sandwiched between slot 55B of open sleeve 40 and slot 55A of mandrel 70. Thus, fluid flow has been shut down, wherein there is neither flow in or out of the preferred embodiment.

On the contrary, fluid flow would be enabled if hydraulic pressure would be applied to the flow opening port 60 whereupon there would be communication between the reservoir and production in this zone being open. According to the present invention, this open condition is achieved when sliding frack valve 35 slides from right to left until the rib cage reaches the recess on the left side thereof and seats therein. Sliding frack valve 35 has thus been urged into an open position wherein its slot 56 is aligned with each of inherently aligned mandrel slot 55A and open sleeve slot 55B. It will be seen that frack valve surface would be sandwiched between slot 55B of open sleeve 40 and slot 55A of mandrel 70. Thus, fluid flow out of the tool would be enabled for fracking and for injecting activity; and fluid flow into the tool would correspond to production of hydrocarbons from the reservoir to the surface.

Figure 6:
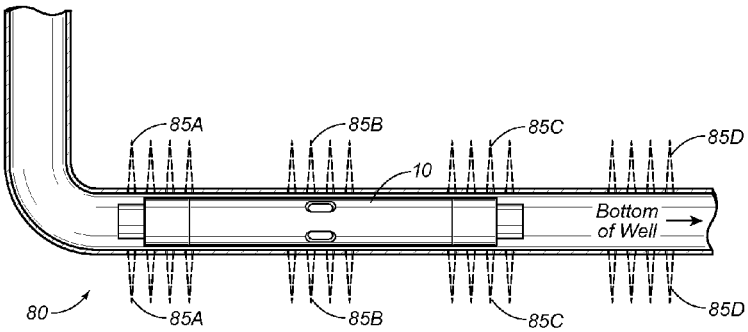
FIG. 6 depicts a simplified schematic view of a frack perforation pattern disposed adjacent the embodiment of the present invention depicted in FIGS. 1-5.

FIG. 6 depicts a simplified schematic view of a frack perforation pattern disposed adjacent an embodiment of the present invention 10. Shown therein, directed downhole, are four frack stages 85A, 85B, 85C, and 85D having plurality of perforations 80, with the downhole tool 10 taught herein positioned downhole. As will be hereinafter explained, tool 10 enables a methodology for selectively opening and/or closing one or more of these four frack stages. For instance, to close one of up to four possible frack zones, a suitable signal would be sent downhole—illustrated herein by hydraulic pressure—through a closing port preferably located on the bottom side of tool 10. This pressure signal urges the sliding frack valve to slide from one side of the tool to the other into a specially configured closed position, wherein the locking rib cage is seated within a corresponding recess to seal off this frack zone being shut down. This lock down sealing protocol taught by the present prevents hydrocarbon fluid from either entering or departing the designated frack zone—through the instant tool 10. It will be seen that, if circumstances necessitate reopening a frack zone, then triggering hydraulic pressure would be applied to the opening port preferably located on the tool top side, the sliding frack valve would be urged to slide in the opposite direction toward the corresponding open position wherein the locking rib cage, disposed at the proximal end of the sliding frack valve, would be locked into a corresponding recess thereat.

It should be appreciated by those skilled in the art that, while the illustrations herein depict two positions of locking rib cage 50, disposed on either side of the preferred embodiments, this is not intended to limit the scope of the self-contained closed flow and open flow system taught hereunder. Hence, embodiments hereof may be configured to accommodate a maximum of four frack stages or production zones by having a suitable variation of the infrastructure elucidated and illustrated herein. It will be understood that embodiments of the present invention enable a well to be subdivided into segments constituting either frac stages or production zones. Such novel segmentation enabled hereunder, in turn, enable selected segments—frack stages or production zones—to be opened and closed in a manner heretofore unknown in the art.

Figure 2A:
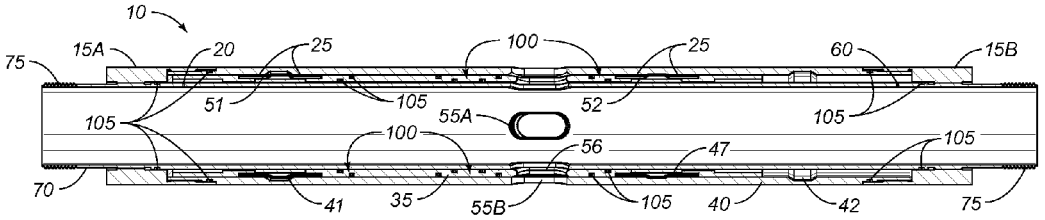
FIG. 2A depicts an enlarged view of the embodiment depicted in FIG. 1, disposed in an open condition.

It will be understood that, for open condition depicted in FIG. 2A, closing port 20 is shown inhibited or blocked from receiving inbound fluid flow, while opening port 60 is shown uninhibited and is poised to received inbound activation fluid pressure engendered from the surface through a cap tool or the like. On the other hand, in FIG. 2B, there is seen a closed condition wherein opening port 60 is shown inhibited or blocked from receiving inbound fluid flow, while closing port 20 is shown uninhibited and is poised to received inbound activation fluid pressure engendered from the surface.

Figure 2B:
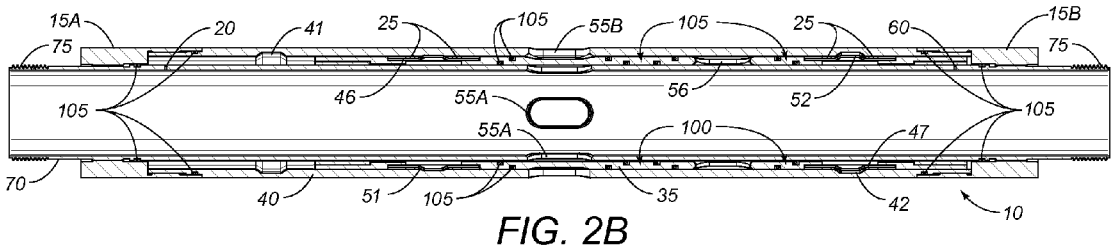
FIG. 2B depicts an enlarged view of the embodiment depicted in FIG. 1, disposed in a closed condition.
Figure 3:
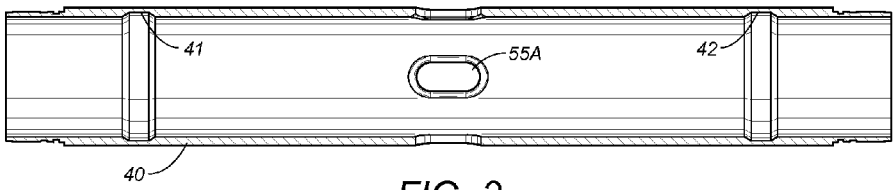
FIG. 3 depicts an isolated view of the open sleeve condition depicted in FIG. 2A.

Still referring to FIGS. 2A-B, there is seen locking rib cage 50 which encloses a plurality of ribs such as rib member 45 on each end hereof. Also shown is pair of cover rings 25 which sustain the integrity and arrangement of locking rib cage 50 as it is caused to move along with sliding frack valve 35 to which it is attached. FIG. 3 depicts an isolated view of the open sleeve condition depicted in FIG. 2A. There is seen recess members 41 and 42, disposed at each end of tool 10 with open sleeve slot 55A shown medially thereof. As a locking rib cage is caused to move from end to the other along with the sliding frack valve, this transition is stopped when the locking rib cage engages a recess and becomes enclosed therein. It will be appreciated that there is an inherent bias for sliding frac valve 35 to travel linearly along its path, thereby limiting rotational deviations thereof which would tend to interfere with proper alignment of sliding frzc valve slot 56 and fixed slots 55A and 55B.

Figure 4:
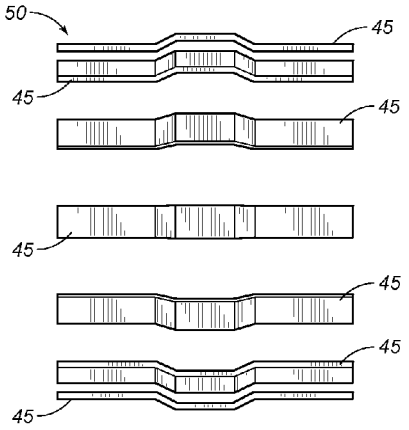
FIG. 4 depicts a simplified frontal perspective views of decompressed rib members contained within the rib cage of the embodiment depicted in FIG. 1.
Figure 5:
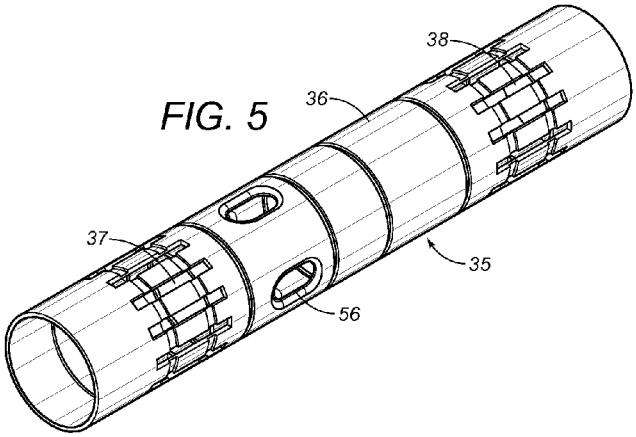
FIG. 5 depicts an isolated frontal perspective view of a sliding frack valve of the embodiment depicted in FIG. 1.

A rib member contemplated herein is deformed strip of metal configured as depicted in simplified frontal perspective views of in FIG. 4. In particular, the compressed rib members shown would be contained within the locking rib cage of the present embodiment. Initially having a flat straight configuration having an elevated step-like middle portion with inclined surfaces of either side thereof, compression would cause the elevated middle portion to become level with the side portions, except that such downward movement of the middle portion tends to cause the each end portion to flare upwards.

Collectively referring now to FIGS. 1-5, there is seen the various positions occupied by individual ribs within an associated locking rib cage encasing a plurality of ribs as contemplated hereunder. As will be hereinafter described, when rib cage 50 is caused to move, its individual rib members are unseated from the outer surface of sliding frack valve 35 and urged to move along with sliding frack valve 35 to the other side of the tool and then become seated there in the proximal recess, either recess 41 or 42, depending upon which side is implicated. The exterior surface of sliding frack valve 35 depicted in FIG. 5 clearly depicts the profiles 37 and 38 thereon that facilitates locking rib cage 50 to be seated thereupon. It should be understood that the ribs 45 are always seated on the sliding frack valve either in a compressed or uncompressed disposition. It will be seen that movement of a locking rib cage 50—either left or right—ceases when the recess 41 or 42 on the opposite end of the tool is reached and the locking rib cage 50 becomes positioned therewithin and immediately becomes uncompressed.

It will be seen that locking rib cage 51 or 52 would be emplaced under pressure in corresponding recess 41 or 42, respectively at the end of slidable movement of sliding frack valve 35 either from left to right or from right to left, depending upon whether the pressure is applied to flow closing port 20 or flow opening port 60, triggering a closed or open condition, respectively. It should be noted that, when the sliding frack valve 35 is disposed in the closed position, the locking rib cage would be seated within the recess of the open sleeve. Consequently, the sealing surface 36 associated with sliding frack valve 35 will be inhibiting fluid flow passage either into or out of the tool, since this sealing surface 36 has become aligned with mandrel slot 55A and open sleeve slot 55B.

Referring now to FIG. 4, there is seen plurality of rib members 50 which, as will become clear to those skilled in the art, are preferably encased within a locking rib cage wherein each rib member 45 is enclosed therein. Pair of cover ring members 25 enclose the locking rib cage to sustain the integrity and placement of the rib contained therein during compression and decompression thereof as contemplated hereunder. Each rib member 45, preferably made from a deformed metal strip, is shown having a middle portion elevated relative to each end portion thereof. All of the plurality of ribs are disposed around the instant downhole tool. When pressure is applied downhole to either the flow opening port 60 or the flow closing port 20, movement of sliding frack valve 35 which, in turn, causes locking rib cage 50 to transition from a recess member disposed at one end to the other opposite recess member. For instance, if the locking rib cage were to be caused to move left with the sliding frack valve to which it is attached, the ribs are no longer decompressed within a recess and become compressed due to entry into a smaller cross-sectional area than was available within the recess. Thus to move into the open sleeve, the ribs must be compressed. It should be understood this spring-like behavior manifest via a caged plurality of rib members may also be accomplished by other devices well known in the art. For example, the compression and decompression enabled via the rib cage and the plurality of deformed ribs contained therein could be effectuated via suitable springs or a series of Belleville rings washers or essentially any type of spring-like members that function to urge the sliding frac valve to decompress into its corresponding recess and remain therein until another signal is received from the surface to trigger further sliding action of the sliding frack valve and emplacement in the recess disposed at the opposite side of the instant multi-frac tool.

It will be appreciated that, according to the present invention, there typically is one set of ribs contained within a locking rib cage seated in a recess in an uncompressed condition. For example, when fluid pressure is received from the surface and input into flow closing port 20, the sliding frack valve 35 is urged to slide from left to right. This sliding motion continues under pressure until the implicated locking rib cage with its compressed plurality of ribs reaches the right recess, whereupon the ribs expand into the extra space.

It will become apparent to those skilled in the art that this same behavior is manifest for an alternative embodiment of the present invention which incorporates a screen filtering feature into its multi-frac functionality. That is, besides the instant multi-frac tool taught herein having the profound ability to selectively open and close up to four frack or production zones, this alternative embodiment thereof also affords an ability to selectively filter out sand and other debris downhole in the reservoir as source thereof. Hence, it should be evident that virtually the same functionality is achieved based upon the analogous structure shown in FIGS. 1-3 and 5, pertaining to one embodiment comprising a sliding frack valve 35, an open sleeve 40 and, of course, a mandrel 70, on the one hand, and shown in FIGS. 7-13 pertaining to another embodiment comprising these same components and a screen-related analogous infrastructure further comprising a screen off port 220, a screen on port 360, a sliding screen valve 230, screen locking rib cage 251, screen slot 256, and screen 300.

Figure 7:
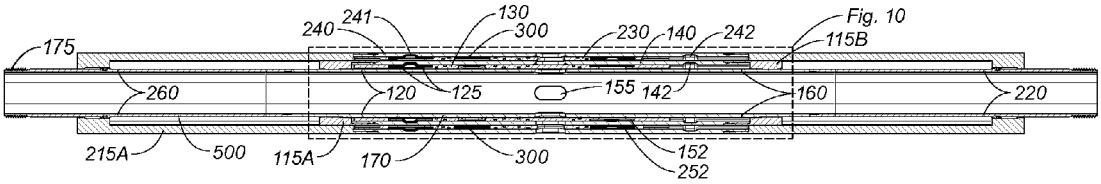
FIG. 7 depicts a cross-sectional view of another embodiment of the present invention depicted in FIG. 13, corresponding to "no flow position with screen off" condition.
Figure 8:
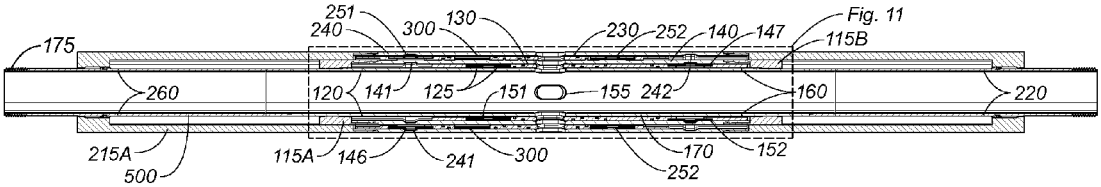
FIG. 8 depicts a cross-sectional view of the embodiment depicted in FIGS. 7 and 13, corresponding to "open flow position with screen off" condition.
Figure 9:
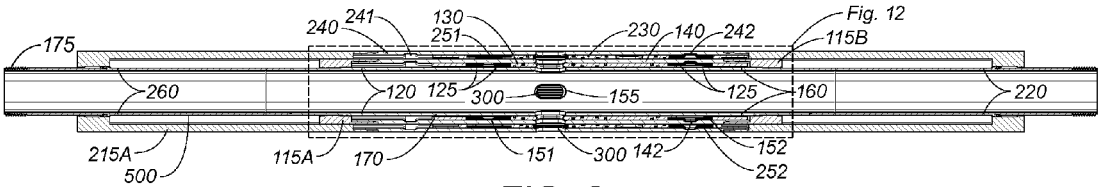
FIG. 9 depicts a cross-sectional view of the embodiment depicted in FIGS. 7 and 13, corresponding to "open flow position with screen on" condition.

More particularly, referring now to FIGS. 7-9, there are depicted cross-sectional views of another embodiment of the present invention having an additional sleeve for accommodating a filtering screen feature. Thus, FIG. 7 depicts a cross-sectional view of this screen embodiment corresponding to "no flow position with screen off" condition. Sliding frack valve 130 has been caused to slide from right to left into the no-flow position wherein locking rib cage 151 is sitting within recess 141. Also, it is seen that there is a screen-off condition because screen locking rib cage is seated within recess 241. Thus, in this arrangement, the present invention has shut down fluid flow and does not invoke a filtering screen.

Similarly, FIG. 8 depicts a cross-sectional view of an embodiment of the present invention corresponding to "open flow position with screen off" condition and FIG. 9 depicts a cross-sectional view corresponding to "open flow position with screen on" condition. Screen 300 is shown in on position in FIG. 9, being visibly active via slot 155. Contrariwise, screen 300 is shown urged into an off position in FIGS. 7 and 8. There is seen screen off port 220 and screen on port 260, sliding screen valve 230 and screen cover ring 225. Also shown is customer specified thread 175, extension 500, flow closing port 120, flow opening port 160, and mandrel 170.

Figures 10A, 10B:
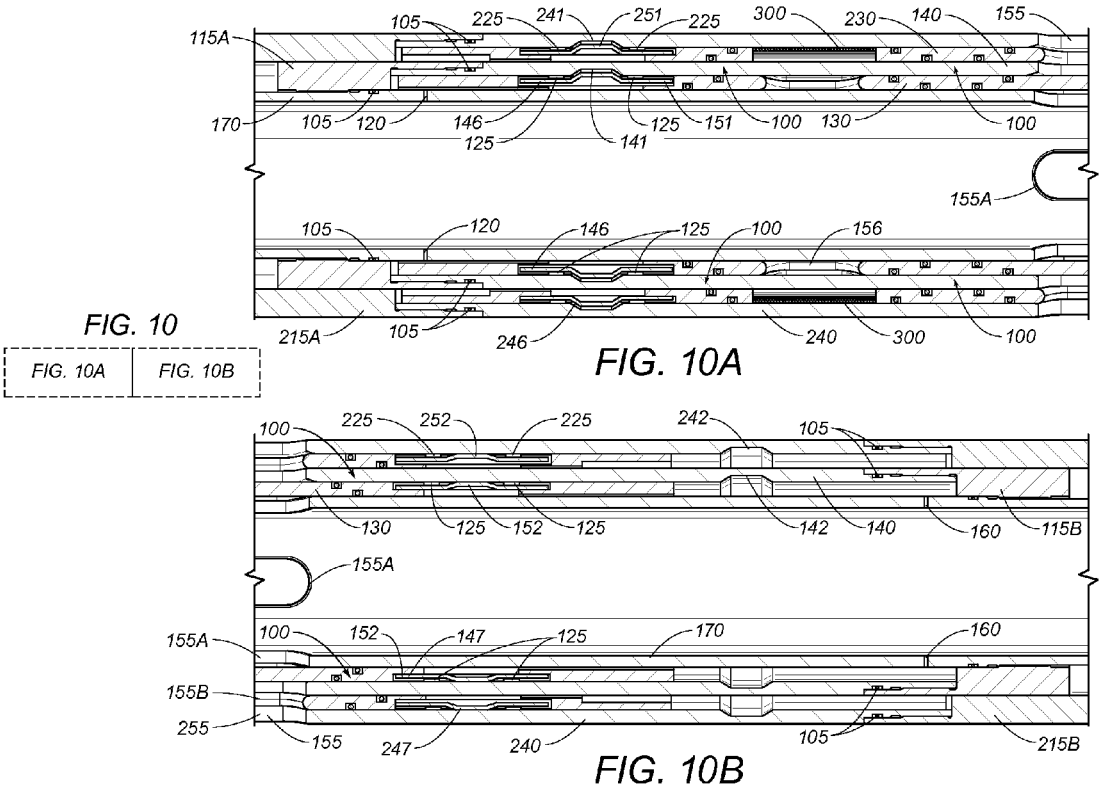
FIGS. 10A and 10B depict enlarged cross-sectional views of the "no flow position with screen off" condition depicted in FIG. 7.
Figures 11A, 11B:
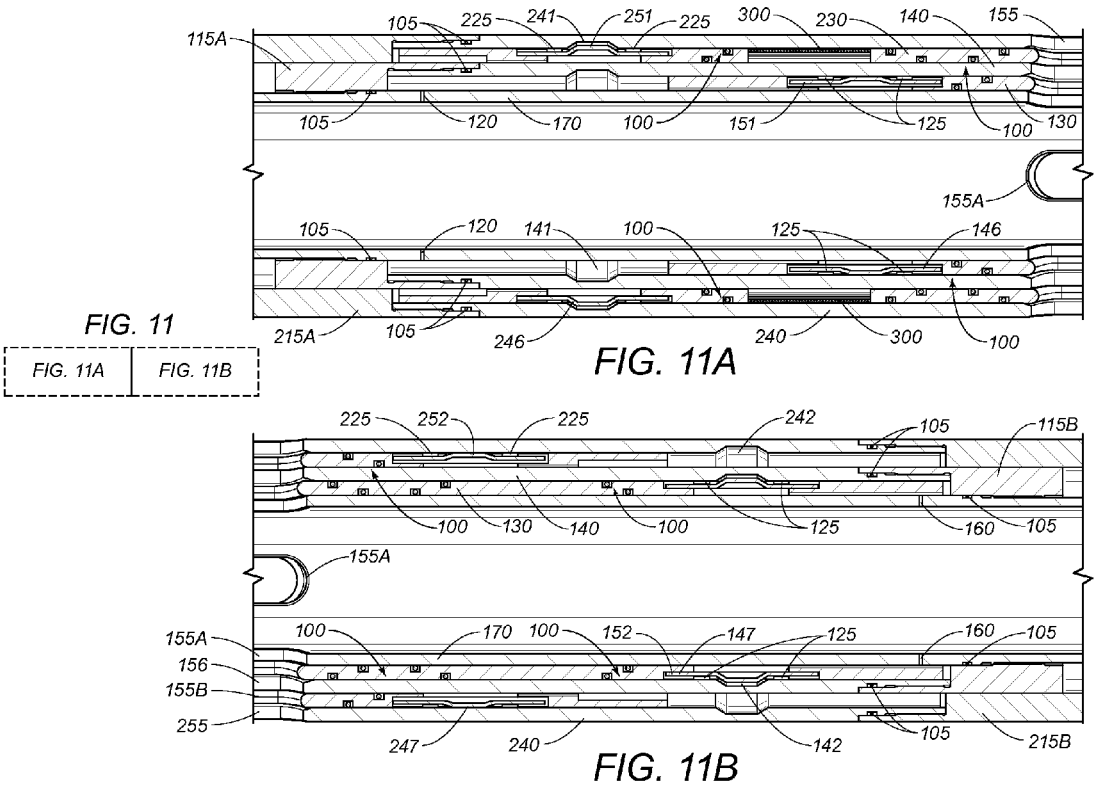
FIGS. 11A and 11B depict enlarged cross-sectional views of the "open flow position with screen off" condition depicted in FIG. 8.
Figure 13:
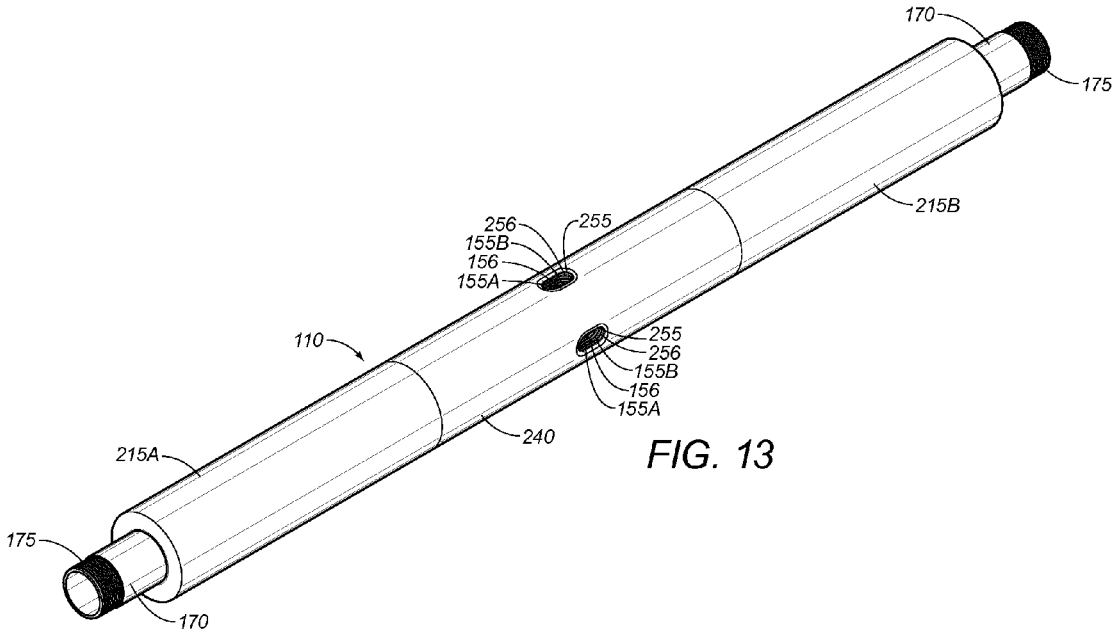
FIG. 13 depicts a frontal perspective view of the embodiment of the present invention depicted in FIGS. 7-12.
Figure 14:
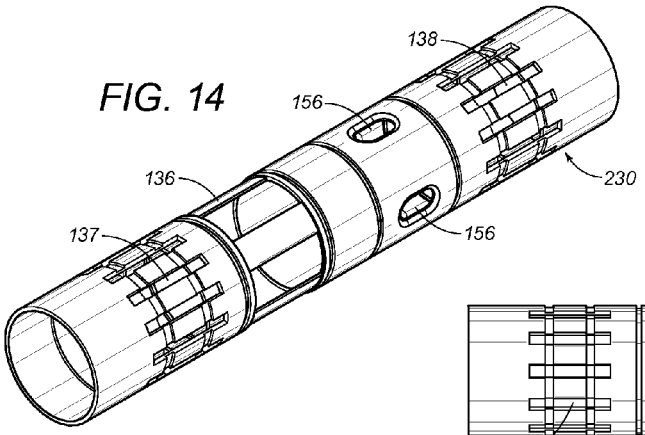
FIG. 14 depicts an isolated frontal perspective view of a sliding screen valve of a filtering screen embodiment of the present invention.
Figure 15:
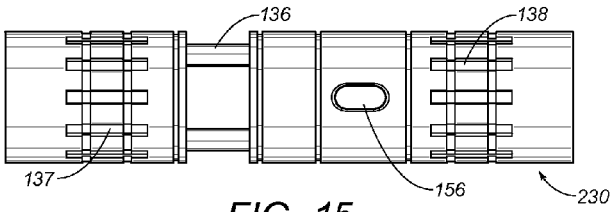
FIG. 15 depicts a frontal view of the sliding screen valve of the filtering screen embodiment depicted in FIG. 14, focusing on the seats for receiving locking rib cage members.
Figure 16:
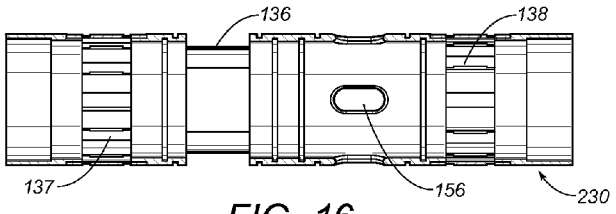
FIG. 16 depicts a frontal cut-away view of the sliding screen valve of the filtering screen embodiment depicted in FIG. 14 and FIG. 15.

FIGS. 10A and 10B depict enlarged cross-sectional views of the "no flow position with screen off" condition depicted in FIG. 7. Shown therein is O-ring 105 representative of a plethora of O-rings permeated throughout the preferred embodiments—occasionally referred to as "Design I" and "Design II"—with Design II having the filtering screen option herein described. FIGS. 11A and 11B depict enlarged cross-sectional views of the "open flow position with screen off" condition depicted in FIG. 8. Similarly, FIGS. 12A and 12B depict enlarged cross-sectional views of the "open flow position with screen on" condition depicted in FIG. 9. Shown therein is sliding frack valve 130 and analogously functioning sliding screen valve 230.

Now referring to FIGS. 10-16, there are depicted various views of the filtering screen embodiment 110 (embodiment II) of the present invention. Similar to the embodiment 10 depicted in FIG. 1 corresponding to embodiment I which is devoid of a filtering screen, downhole tool 110 comprises open sleeve 240 is affixed to mandrel 170 with customer-specified threads 175 depicted at each end of mandrel 170. At each end of embodiment 110 is end cap 215 A-B, This filter screen multi-frack tool would be emplaced downhole and preferably be permanently situated connected to a packer pair (not shown). Mandrel 170 and open sleeve remain fixed 140; only the sliding frack valve 135 moves along the mandrel as will be hereinafter described. Flow closing port 120 is shown at one end and flow opening port is shown at the opposite end thereof. It will be appreciated that each of these fluid flow ports should preferably comprise a plurality of channels that are preferably disposed in a concentric and coplanar configuration. Thus, to shut down fluid flow, hydraulic pressure would be applied to the flow closing port 120 whereupon there would be no communication between the reservoir and production in this zone being closed. According to the present invention, this shutdown is achieved when sliding frack valve 135 slides from left to right until the locking rib cage 151 reaches the recess 242 on the right side thereof and seats therein. Sliding frack valve 135 has thus been urged into a closed position wherein its slot 156 is misaligned with each of the inherently aligned mandrel slot 155A and open sleeve slot 155B. It will be seen that frack valve surface would be sandwiched between slot 155B of open sleeve 140 and slot 155A of mandrel 170. Thus, fluid flow has been shut down, wherein there is neither flow in or out of this embodiment.

On the contrary, fluid flow would be enabled if hydraulic pressure would be applied to the flow opening port 160 whereupon there would be communication between the reservoir and production in this zone being open. According to the present invention, this open condition is achieved when sliding frack valve 135 slides from right to left until the locking rib cage 151 reaches the recess 141 on the left side thereof and seats therein. Sliding frack valve 135 has thus been urged into an open position wherein its slot 156 is aligned with each of inherently aligned mandrel slot 155A and open sleeve slot 155B. It will be seen that frack valve sealing surface 136 would be sandwiched between clot 155B of open sleeve 140 and slot 155A of mandrel 170. Thus, fluid flow out of the tool would be enabled for fracking or into the tool for injecting activity; and fluid flow out of the tool would correspond to production of hydrocarbons from the reservoir to the surface.

For this filtering screen embodiment of the present invention, it will be appreciated that a similar structure and functional relationship exists for the intermediate sliding screen valve 230 and its associated components contemplated hereunder. In particular, open screen sleeve 240 is affixed to mandrel 170. At each end of this screen embodiment is outer end cap 215 A-B, It will be understood that this filter screen multi-frac tool would be emplaced downhole and could be situated connected to packers or other downhole tools or to pipes. Mandrel 170 and open sleeve remain fixed 240; only the sliding frack valve 230 moves along the mandrel as will be hereinafter described. Screen closing port 220 is shown at one end and screen opening port 260 is shown at the opposite end thereof. It will be appreciated that each of these screen ports should preferably comprise a plurality of channels that are preferably disposed in a concentric and coplanar configuration. Thus, to shut down screen filtering, hydraulic pressure would be applied to the screen closing port 220 whereupon no filtering would be effectuated during fracking or production in this zone being closed. According to the present invention, this shutdown is achieved when sliding screen valve 230 slides from right to left until the locking rib cage 252 reaches the recess 242 on the left side thereof and seats therein. Sliding screen valve 230 has thus been urged into a no-screen position wherein its slot 256 is misaligned with each of the inherently aligned mandrel slot 255A and open sleeve slot 255B. Thus, the screen 300 has not been invoked, wherein filtering is not occurring.

On the contrary, screen filtering would be enabled if hydraulic pressure would be applied to the screen opening port 260. According to the present invention, this open condition is achieved when sliding screen valve 230 slides from left to right until the screen locking rib cage 251 reaches the recess 241 on the right side thereof and seats therein. Sliding screen valve 230 has thus been urged into an active filtering position wherein its slot 256 is aligned with each of inherently aligned mandrel slot 255A and screen open sleeve slot 255B.

As will become apparent to those skilled in the art, once the instant multi-frac tool is emplaced downhole and situated proximal to a packer pair. The mandrel and open sleeve members remain fixed; only the sliding frack valve and sliding screen valve move along the mandrel as will be herein described. The locking rib cage and screen rib cage of the present invention are caused to slide along with the implicated sliding frack valve or sliding screen valve, as appropriate, and become engaged in a corresponding recess disposed at the end to which the sliding motion is directed. When the locking condition has been activated, this methodology locks out fluid flow from embodiments hereof and shuts down the frack stage or production zone; and either precludes or enables filtering of sand and particulate impurities as a function of whether the screen has been urged into a screen-on or screen-off position. Which of these screen conditions has been realized, as has been herein elucidated, is functionally related to the direction of the sliding movement of the sliding screen valve that has been urged from the surface, and the interaction between the locking screen rib cages disposed upon the sliding screen valve and their corresponding screen recesses.

Thus, it should be evident to those skilled in the art that the present invention teaches downhole tools having unique structure and functionality that enables up to four frack zones or production zones to be selectively opened or closed by receiving triggering signal via hydraulic downhole pressure or other means known in the art such as electrical signals. It is contemplated to within the scope of the present invention to subdivide a well into different segments or fracking up to four zones with a maximum of about 50 meters between fracks, wherein such a segment would devolve to about 200 meters. It has been shown hereunder that the instant multi-frac tool affords superior sealing characteristics which, of course, is especially useful to achieve a bona fide no-flow condition.

The following tabulation enumerates and identifies the various components comprising embodiments of the present invention.

Multi-Frac Tool Components

| Numeral | Description | Comments & Explanation |
|---|---|---|
| 10 | Multi-Frac tool | |
| 15A | End cap | Design I |
| 15B | End cap | Design I |
| 20 | Flow Closing port | Design I |
| 25 | Cover ring | Design I |
| 35 | Sliding frack valve | Design I |
| 36 | Sealing surface | Sealing surface in Sliding Frack Valve (design I) |
| 37 | Seats | Locking rib member/cage seats in Sliding Frack Valve (design I), close to Sliding Frack Valve Slot |
| 38 | Seats | Locking rib member/cage seats in Sliding Frack Valve (design I), close to Sliding Frack Valve sealing surface |
| 40 | Open sleeve | Design I |
| 41 | Recess | Recess in Open Sleeve Close to member 15A Design I |
| 42 | Recess | Recess in Open Sleeve Close to member 15B Design I |
| 45 | Rib member | Design I |
| 46 | Locking Rib member | Sitting in 37 Design I |
| 47 | Locking Rib member | Sitting in 38 Design I |
| 50 | Locking rib cage | |
| 51 | Locking Rib Cage | Sitting in 37 Design I |
| 52 | Locking Rib Cage | Sitting in 38 Design I |
| 55A, B | Slot | Refers to the 2 slots, the one in the Open Sleeve and the one in the Mandrel Design I |
| 56 | Slot | Sliding Frack Valve Slot design I |
| 60 | Flow Opening port | Design I |
| 65 | Rib housing cap | Design I |
| 70 | Mandrel | Design I |
| 75 | Customer Threads | Design I |

-continued

| Multi-Frac Tool Components | | |
|---|---|---|
| Numeral | Description | Comments & Explanation |
| 80 | Plurality of Perforations | |
| 85A | Frack stage | Close to heal of vertical well |
| 85B | Frack stage | The 2nd from heal of vertical well |
| 85C | Frack stage | The 3rd from heal of vertical well |
| 85D | Frack stage | Close to bottom of horizontal well |
| 100 | Plurality of O-Rings | |
| 105 | Single O-Ring | |
| 115A | End cap | Design II |
| 115B | End cap | Design II Opposite end |
| 120 | Flow Closing Port | Design II |
| 125 | Cover Ring | Design II |
| 130 | Sliding frack valve | Design II |
| 136 | Sealing surface | Sealing surface in Sliding Frack Valve (design II) |
| 137 | Seats | Locking rib member/cage seats in Sliding Frack Valve (design II), close to Sliding Frack Valve Slot |
| 138 | Seats | Locking rib member/cage seats in Sliding Frack Valve (design II), close to Sliding Frack Valve sealing surface |
| 140 | Open sleeve | Design II |
| 141 | Recess | Recess in Open Sleeve Close to member 115A Design II |
| 142 | Recess | Recess in Open Sleeve Close to member 115B Design II |
| 145 | Locking Rib member | Design II |
| 146 | Locking Rib member | Sitting in 137 Design II |
| 147 | Locking Rib member | Sitting in 138 Design II |
| 150 | Locking Rib Cage | Plurality of ribs Design II |
| 151 | Locking Rib Cage | Sitting in 137 Design II |
| 152 | Locking Rib Cage | Sitting in 138 Design II |
| 155A, B | Slot | Refers to the 2 slots, the one in the Open Sleeve and the one in the Mandrel Design II |
| 156 | Slot | Sliding Frack Valve Slot design II |
| 160 | Flow Opening Port | Design II |
| 170 | Multi-frac mandrel | |
| 175 | Customer Thread | |
| 215A | Outer End Cap | |
| 215B | Outer End Cap | Opposite |
| 220 | Screen Off Port | |
| 225 | Screen Cover Ring | |
| 230 | Sliding Screen Valve | |
| 237 | Seats | Locking rib member/cage seats in Screen Sliding Valve (design II), close to Screen |
| 238 | Seats | Locking rib member/cage seats in Screen Sliding Valve (design II), close to Screen Sliding Valve Slot |
| 240 | Screen Open Sleeve | |
| 241 | Recess | Recess in Open Sleeve Close to member 215A Design II |
| 242 | Recess | Recess in Open Sleeve Close to member 215B Design II |
| 245 | Screen Rib member | |
| 250 | Screen Locking Rib Cage | |
| 255A, B | Slots | Mandrel & screen open sleeve |
| 256 | Slot | Screen Sliding Valve Slot design II |
| 260 | Screen On Port | |
| 300 | Screen | |
| 500 | Extension | |

Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the present invention is to be measured by the scope of the appended claims herein.

What is claimed is:

1. A downhole multi-frac tool having a plurality of interdependent components, comprising:

an axially disposed cylindrical mandrel having a first centrally disposed slot therethrough and a threaded connection at each end thereof for connecting to a downhole packer therewith;

an open sleeve affixed to said mandrel and having a second centrally disposed slot therethrough, said second centrally disposed slot being congruent with said first centrally disposed slot and being aligned therewith;

a sliding frac valve slidably disposed between said mandrel and said open sleeve, and having third centrally disposed slot therethrough, said third centrally disposed slot being congruent with said first centrally disposed slot and said second centrally disposed slot;

a pair of locking spring-like members with each locking spring-like member thereof being fixedly attached at an opposite end of said sliding frac valve and enclosed with a cover ring therearound;

a pair of recesses with each recess thereof sized to receive one of said locking spring-like members in an uncompressed condition;

a pair of end caps with each end cap affixed to an opposite end of said open sleeve;

a first port for receiving a first signal from the well surface to responsively cause said sliding frac valve to slide linearly into an open position wherein said third centrally disposed slot is aligned with said first centrally disposed slot and said second centrally disposed slot, thereby enabling hydrocarbon fluid to flow therethrough;

a second port for receiving a second signal from the well surface to responsively cause said sliding frac valve to slide linearly into a closed position wherein said third centrally disposed slot is misaligned with said first centrally disposed slot and said second centrally disposed slot, thereby disabling hydrocarbon fluid from flowing therethrough; and a plurality of O-rings interspersed among said plurality of components, with a first portion thereof inserted within each said component's interstices and with a second portion thereof inserted between said components' interfaces.

2. The downhole multi-frac tool recited in claim 1, wherein each said locking spring-like member comprises a locking rib cage.

3. The downhole multi-frac tool recited in claim 2, wherein each said locking rib cage houses a plurality of ribs adapted to be configured in an uncompressed or compressed condition.

4. The downhole multi-frac tool recited in claim 1, wherein said responsively opening and closing said slots for enabling or disabling hydrocarbon fluid flow, in turn, enables a well to be subdivided into segments corresponding to frack stages or production zones.

5. The downhole multi-frac tool recited in claim 4, wherein said segmentation enables each said frack stage or each production zone to be selectively opened or closed.

6. A downhole multi-frac tool having a plurality of interdependent components, comprising:

an axially disposed cylindrical mandrel having a first centrally disposed slot therethrough and a threaded connection at each end thereof for connecting to a downhole packer therewith;

an open sleeve affixed to said mandrel and having a second centrally disposed slot therethrough, said second centrally disposed slot being congruent with said first centrally disposed slot and being aligned therewith;

a sliding frac valve slidably disposed between said mandrel and said open sleeve, and having third centrally disposed slot therethrough, said third centrally disposed slot being congruent with said first centrally disposed slot and said second centrally disposed slot;

a pair of locking rib cages with each locking rib cage thereof being fixedly attached at an opposite end of said sliding frac valve and housing a plurality of ribs adapted to be configured in an uncompressed or compressed condition;

a pair of recesses with each recess thereof sized to receive one of said locking rib cages in an uncompressed condition;

a pair of end caps with each end cap affixed to an opposite end of said open sleeve;

a first port for receiving a first signal from the well surface to cause said sliding frac valve to slide linearly into an open position wherein said third centrally disposed slot is aligned with said first centrally disposed slot and said second centrally disposed slot;

a second port for receiving a second signal from the well surface to cause said sliding frac valve to slide linearly into a closed position wherein said third centrally disposed slot is misaligned with said first centrally disposed slot and said second centrally disposed slot;

a screen open sleeve affixed to said mandrel and having a fourth centrally disposed slot therethrough, said fourth centrally disposed slot being congruent with said first centrally disposed slot and being aligned therewith;

a screen sliding valve slidably disposed between said mandrel and said screen open sleeve, and having fifth centrally disposed slot therethrough, said fifth centrally disposed slot being congruent with said first centrally disposed slot and said fourth centrally disposed slot;

a pair of screen locking rib cages with each screen locking rib cage thereof being fixedly attached at an opposite end of said screen sliding valve and enclosed with a screen cover ring therearound, and housing a plurality of ribs adapted to be configured in an uncompressed or compressed condition;

a pair of screen recesses with each screen recess thereof sized to receive one of said screen locking rib cages in an uncompressed condition;

a pair of screen end caps with each screen end cap affixed to an opposite end of said screen open sleeve;

a first screen port for receiving a third signal from the well surface to responsively cause said screen sliding valve to slide linearly into a screen-on position wherein said fourth centrally disposed slot is aligned with said first centrally disposed slot and said fifth centrally disposed slot;

a second screen port for receiving a fourth signal from the well surface to responsively cause said screen sliding valve to slide linearly into a screen-off position wherein said fourth centrally disposed slot is misaligned with said first centrally disposed slot and said fifth centrally disposed slot; and a plurality of O-rings interspersed among said plurality of components, with a first portion thereof inserted within each said component's interstices and with a second portion thereof inserted between said components' interfaces.

* * * * *